US007878500B2

(12) United States Patent
Wakakusa

(10) Patent No.: US 7,878,500 B2
(45) Date of Patent: Feb. 1, 2011

(54) SHEET STORING DEVICE AND IMAGE RECORDING APPARATUS COMPRISING SHEET STORING DEVICE

(75) Inventor: Keisuke Wakakusa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/567,456

(22) Filed: Sep. 25, 2009

(65) Prior Publication Data

US 2010/0164169 A1 Jul. 1, 2010

(30) Foreign Application Priority Data

Dec. 26, 2008 (JP) ..... 2008-332166

(51) Int. Cl.
*B65H 1/00* (2006.01)

(52) U.S. Cl. ..... 271/162; 271/164; 271/9.11

(58) Field of Classification Search ..... 271/162, 271/164

See application file for complete search history.

(56) References Cited

U.S. PATENT DOCUMENTS

| | | | | |
|---|---|---|---|---|
| 3,989,236 | A * | 11/1976 | Komori et al. | 271/160 |
| 4,025,066 | A * | 5/1977 | Sue | 271/164 |
| 7,731,179 | B2 * | 6/2010 | Izuchi et al. | 271/162 |
| 2005/0225025 | A1 * | 10/2005 | Chikumoto | 271/162 |
| 2007/0182803 | A1 | 8/2007 | Asada et al. | |
| 2007/0200285 | A1 | 8/2007 | Shiohara | |
| 2008/0128975 | A1 * | 6/2008 | Sosnowski et al. | 271/162 |
| 2009/0085278 | A1 * | 4/2009 | Izuchi et al. | 271/145 |

FOREIGN PATENT DOCUMENTS

| | | | |
|---|---|---|---|
| JP | S53-028424 | Y1 | 7/1978 |
| JP | 3056436 | U * | 2/1999 |
| JP | 2001-301994 | A | 10/2001 |
| JP | 2002-179258 | A | 6/2002 |
| JP | 2007-230777 | A | 9/2007 |

OTHER PUBLICATIONS

Japan Patent Office; Notice of Reasons for Rejection in Japanese Patent Application No. 2008-332166 (counterpart to the above-captioned U.S. Patent Application) mailed on Sep. 14, 2010.

* cited by examiner

*Primary Examiner*—Stefanos Karmis
*Assistant Examiner*—Gerald W McClain
(74) *Attorney, Agent, or Firm*—Baker Botts L.L.P.

(57) ABSTRACT

A sheet storing device includes a container including a first holding surface configured to hold a first sheet thereon, and a tray positioned at an upper side of the container. The tray includes a second holding surface configured to hold a second sheet thereon. The tray is configured to selectively move between a first position and a second position downstream from the first position in a first direction. The sheet storing device further includes a positioning unit configured to selectively position the tray in one of the first position and the second position, and a linking unit configured to link the tray to the container and to pivot about a particular pivot axis which extends in a second direction perpendicular to the first direction and parallel to the first holding surface of the container. The linking unit pivots to selectively move the tray between the first position and the second position.

14 Claims, 8 Drawing Sheets

SHEET STORING DEVICE AND IMAGE RECORDING APPARATUS COMPRISING SHEET STORING DEVICE

CROSS REFERENCE TO RELATED APPLICATION

The present application claims priority from Japanese Patent Application No. 2008-332166, which was filed on Dec. 26, 2008, the disclosure of which is incorporated herein by reference in its entirety.

BACKGROUND OF THE INVENTION

1. Field of the Invention

The invention relates to a sheet storing device that comprises a container for storing a first sheet and a tray for storing a second sheet. The invention also relates to an image recording apparatus that comprises such a sheet storing device and is configured to selectively feed a first sheet and a second sheet from the sheet storing device and to record an image on the fed sheet.

2. Description of Related Art

A known printer, e.g., an inkjet printer or a laser printer, for recording an image on a sheet of recording medium comprises a sheet storing device, e.g., a sheet cassette. The sheet storing device is configured to store sheets of a predetermined standard size. The printer records an image on a sheet fed from the storing device.

A known sheet storing device is configured to store therein sheets of two different standard sizes and comprises a first tray and a second tray arranged vertically. The second tray is configured to slide on the first tray between a position remote from a feed roller and a position close to the feed roller. The sheet storing device comprises a lock mechanism for locking the second tray to the first tray in a fixed position.

In the known sheet storing device, the second tray is slidable on the first tray when the second tray is not locked to the first tray in the fixed position. When the sheet storing device is used in the printer with the second tray unlocked to the first tray, the feed roller may not be positioned correctly with respect to the first tray and the second tray, and the feed roller may fail to feed sheets or may be damaged by a collision with the second tray.

SUMMARY OF THE INVENTION

Therefore, a need has arisen for a sheet storing device and an image recording apparatus that overcome these and other shortcomings of the related art. A technical advantage of the invention is that a tray of the sheet storing device is reliably positioned and retained in a predetermined position with respect to a container of the sheet storing device.

According to an embodiment of the invention, a sheet storing device comprises a container comprising a first holding surface configured to hold a first sheet thereon, and a tray positioned at an upper side of the container. The tray comprises a second holding surface configured to hold a second sheet thereon. The tray is configured to selectively move between a first position and a second position downstream from the first position in a first direction. The sheet storing device further comprises a positioning unit configured to selectively position the tray in one of the first position and the second position, and a linking unit configured to link the tray to the container and to pivot about a particular pivot axis which extends in a second direction perpendicular to the first direction and parallel to the first holding surface of the container. The linking unit pivots to selectively move the tray between the first position and the second position.

According to another embodiment of the invention, an image recording apparatus comprises a sheet storing device, a housing, a feed roller, and a recording unit. The sheet storing device comprises a container comprising a first holding surface configured to hold a first sheet thereon, and a tray positioned at an upper side of the container. The tray comprises a second holding surface configured to hold a second sheet thereon. The tray is configured to selectively move between a first position and a second position downstream from the first position in a first direction. The sheet storing device further comprises a positioning unit configured to selectively position the tray in one of the first position and the second position, and a linking unit configured to link the tray to the container and to pivot about a particular pivot axis which extends in a second direction perpendicular to the first direction and parallel to the first holding surface of the container. The linking unit pivots to selectively move the tray between the first position and the second position. The sheet storing device is detachably inserted into the housing along the first direction. The feed roller is positioned in the housing and is configured to move between a third position and a fourth position. The feed roller is configured, when located in the third position, to contact the first sheet in the container and feed the first sheet in the first direction when the tray is in the first position, and the feed roller is configured, when located in the fourth position, to contact the second sheet in the tray and feed the second sheet in the first direction when the tray is in the second position. The recording unit is positioned in the housing and is configured to record an image on the first sheet and the second sheet fed by the feed roller from the sheet storing device.

Other advantages of the present invention will be apparent to persons of ordinary skill in the art in view of the following detailed description of the invention and the accompanying drawings.

BRIEF DESCRIPTION OF THE DRAWINGS

For a more complete understanding of the present invention, and the needs satisfied thereby, reference now is made to the following descriptions taken in connection with the accompanying drawings.

DETAILED DESCRIPTION OF EMBODIMENTS

Figure 1:
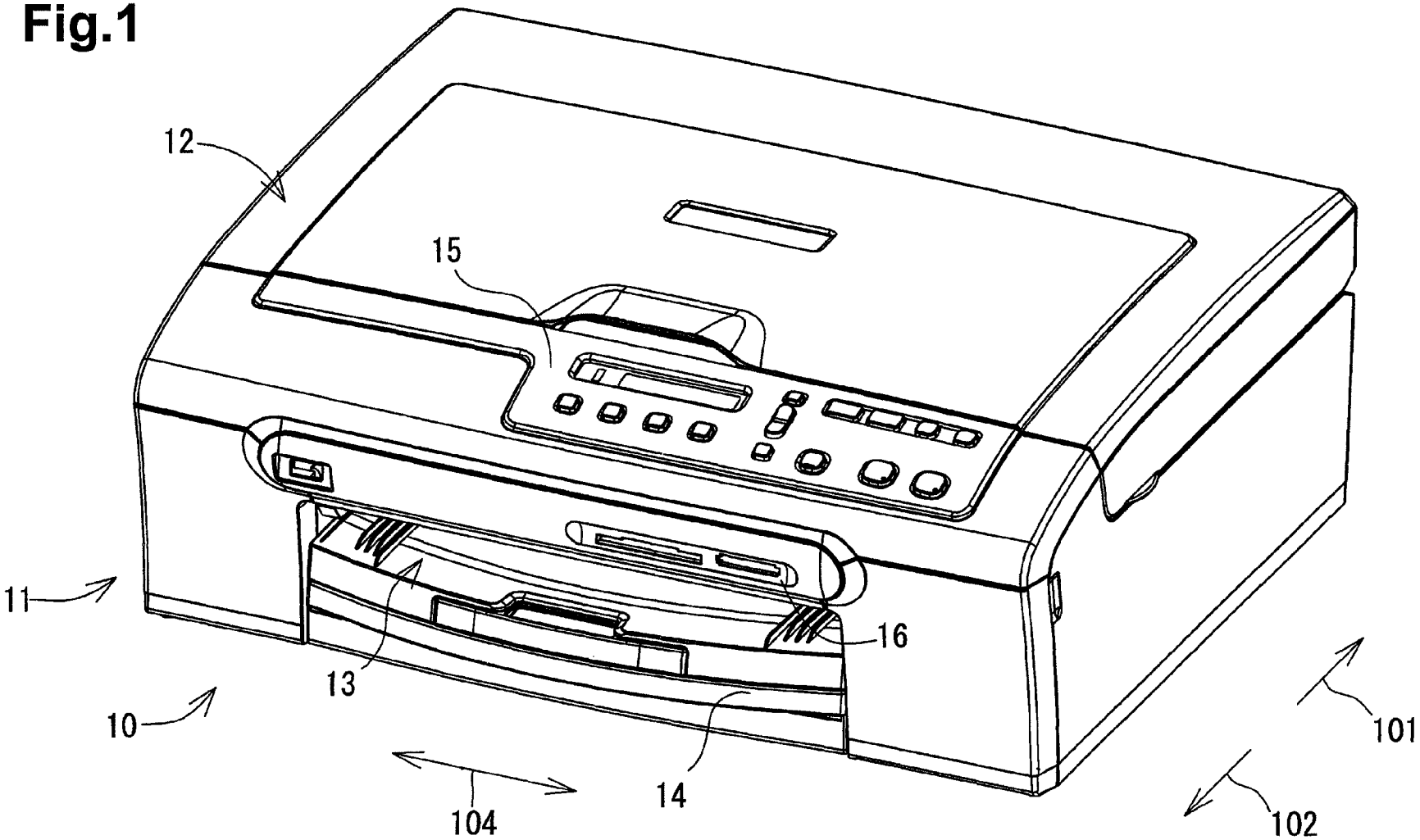
FIG. 1 is a perspective view of an image recording device, e.g., a multi-function device, according to a first embodiment of the invention.

Embodiments of the invention may be understood by referring to FIGS. 1-8, like numerals being used for like corresponding parts in the various drawings.

An image recording apparatus, e.g., a multi-function device 10, may comprise a printer 11 and a scanner 12, and may perform one or more functions, e.g., printing, copying, scanning, facsimile functions, or any combination thereof.

The printer 11 of the multi-function device 10 may be connected to an external device, e.g., a computer and a digital camera, and may be configured to record an image, e.g., text or the like, on a sheet of recording medium based on image data transmitted form the external device. Various storage media, e.g. card-type memories, may be inserted into the multi-function device 10, and the printer 11 may record an image on a sheet based on image data stored in a storage medium.

The multi-function device 10 has a substantially box shape, and has a width and a depth which are greater than a height thereof. The printer 11 is disposed at a lower portion of the multi-function device 10. The printer 11 has an opening 13 at a front of the multi-function device 10. A sheet cassette 14 is inserted into a main body of the multi-function device 10 through the opening 13, and is removed from the main body by pulling the sheet cassette 14 frontward. In the following description, the expressions "front", "rear", "upper", "lower", "right", and "left" are used to define the various parts when the multi-function device 10 is disposed in an orientation in which it is intended to be used. Arrow 101 indicates an inserting direction of the sheet cassette 14, and arrow 102 indicates a removing direction of the sheet cassette 14. Arrow 104 indicates a width direction, i.e., right-left direction, of the multi-function device 10 as well as a width direction, i.e., right-left direction, of the sheet cassette 14.

A scanner 12 is disposed at an upper portion of the multi-function device 10, and may be a flatbed scanner.

An operation panel 15 is disposed at a front upper portion of the multi-function device 10. The operation panel 15 is used to operate the printer 11 and the scanner 12. The operation panel 15 comprises various operation buttons and a liquid crystal display. The multi-function device 10 operates in accordance with an operation instruction from the operation panel 15. When the multi-function device 10 is connected to an external information device, the multi-function device 10 may operate in accordance with an instruction transmitted from the external information device through a printer driver or a scanner driver. A slot 16 is disposed at the front of the multi-function device 10. A memory card is inserted into the slot 16, and data is read from or written to the memory card.

Figure 2:
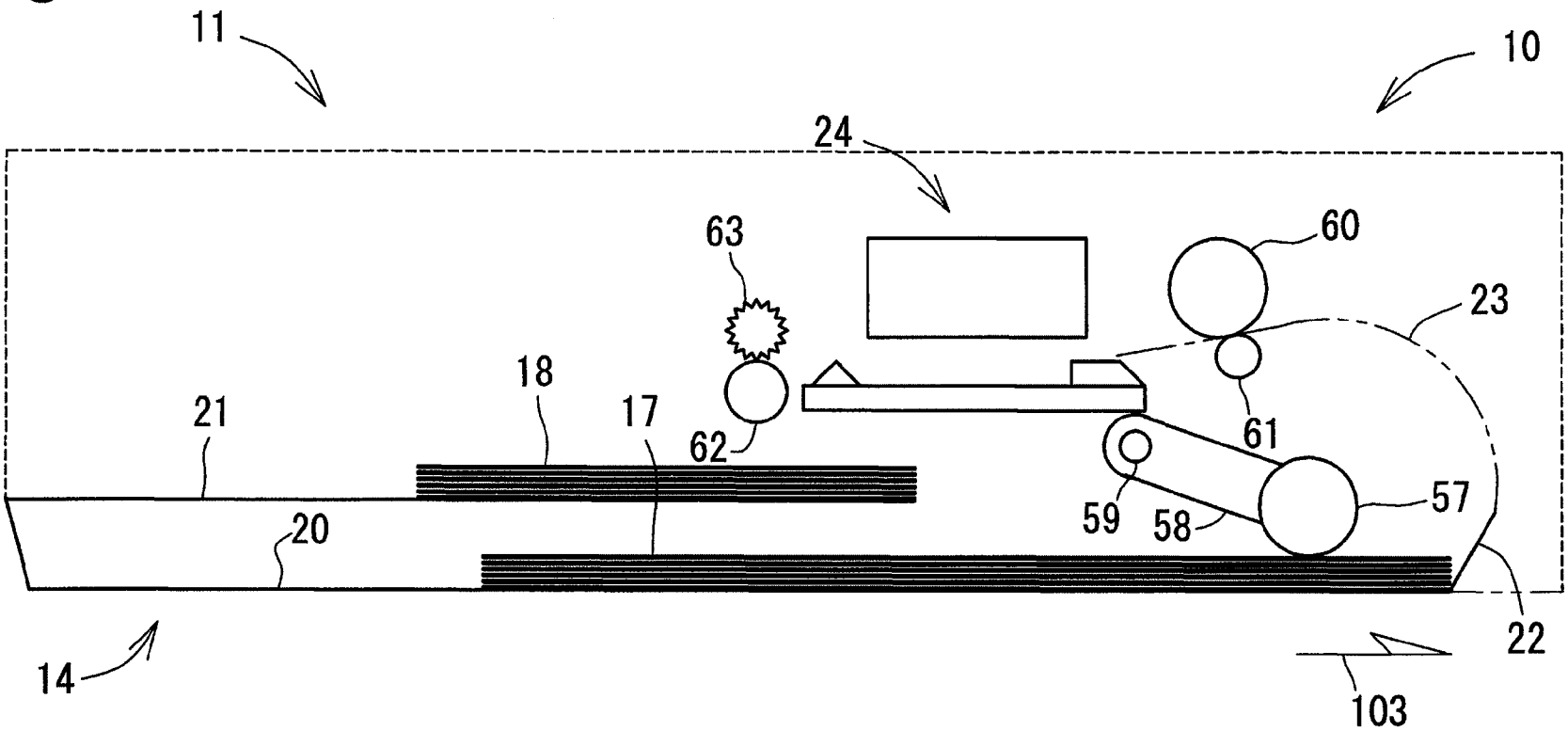
FIG. 2 is a schematic diagram illustrating an internal configuration of a printer of the image recording device.

A general configuration of the printer 11 will now be described. As illustrated in FIG. 2, the sheet cassette 14 is disposed at the bottom of the multi-function device 10. The sheet cassette 14 includes a container 20 and a tray 21. The container 20 is configured to hold sheets 17 of a predetermined size, e.g., an A4 size or smaller. The container 20 may comprise a slide tray configured to slide to increase a tray surface area, such that the container 20 hold sheets, e.g., legal-size sheets, having a size greater than a predetermined size, e.g., an A4 size.

A separation plate 22 is disposed at the rear of the container 20. An upper end of the separation plate 22 is inclined toward the rear of the printer 11, i.e., rightward in FIG. 2. Even if two or more sheets 17 are fed from the container 20 in an overlapping manner by rotation of a feed roller 57, these sheets 17 are separated by the separation plate 22 and only the uppermost sheet 17 is guided upward along the slope of the separation plate 22.

The tray 21 partially closes the top of the container 20. The container 20 is open at the top, and the position of the tray 21 is selectively changed such that the opening of the container 20 is partially closed. The tray 21 serves as a feed tray for holding sheets 18 to be recorded thereon, and also as a discharge tray for receiving in a stacked state the sheets 17 and 18 having an image recorded thereon. The sheets 17 or 18 are conveyed one by one from the container 20 or the tray 21, along a sheet conveying path 23, to the tray 21. A recording unit 24 records an image onto the sheet 17 or the sheet 18 being conveyed.

The feed roller 57 is positioned above the container 20 when the sheet cassette 14 is inserted into the main body of the multi-function device 10. On the rear side, i.e., right side in FIG. 2, of the multi-function device 10, the feed roller 57 comes into contact with the sheets 17 stacked in the container 20 or the sheets 18 staked in the tray 21. The feed roller 57 is supported by a free end of an arm 58. The feed roller 57 is rotated, via a drive transmission mechanism, by a motor (not shown) as a driving source.

The arm 58 is supported at its base end by a shaft 59. The arm 58 is pivotable about the shaft 59. Pivoting of the arm 58 causes the feed roller 57 to move up and down such that the feed roller 57 moves away from and close to the container 20 or the tray 21. The arm 58 is elastically biased downward by its own weight or by a spring, or by both. When the sheet cassette 14 is inserted into the multi-function device 10, the container pushes up the arm 58, and then the arm 58, which is usually elastically biased downward, pivots downward and contacts the sheets 17 in the container 20 or the sheets 18 in the tray 21. Then, when the feed roller 57 is rotated, the sheet 17 or the sheet 18 is fed to the sheet conveying path 23.

The sheet conveying path 23 has a U shape and extends upward from the upper end of the separation plate 22, makes a U-turn, and extends further toward the front of the multi-function device 10. An outer guide (not shown) and an inner guide are coupled to a housing of the printer 11 and define the sheet conveying path 23.

Conveying rollers 60 and 63 convey the sheet 17 or the sheet 18 along the sheet conveying path 23. The recording unit 24 performs image recording on the sheet 17 or the sheet 18 being conveyed. The recording unit 24 may be, for example, an inkjet recording unit, an electrophotographic recording unit, or a thermal recording unit. After the image recording, the sheet 17 or the sheet 18 is discharged from the sheet conveying path 23 onto the tray 21 of the sheet cassette 14.

Figure 3:
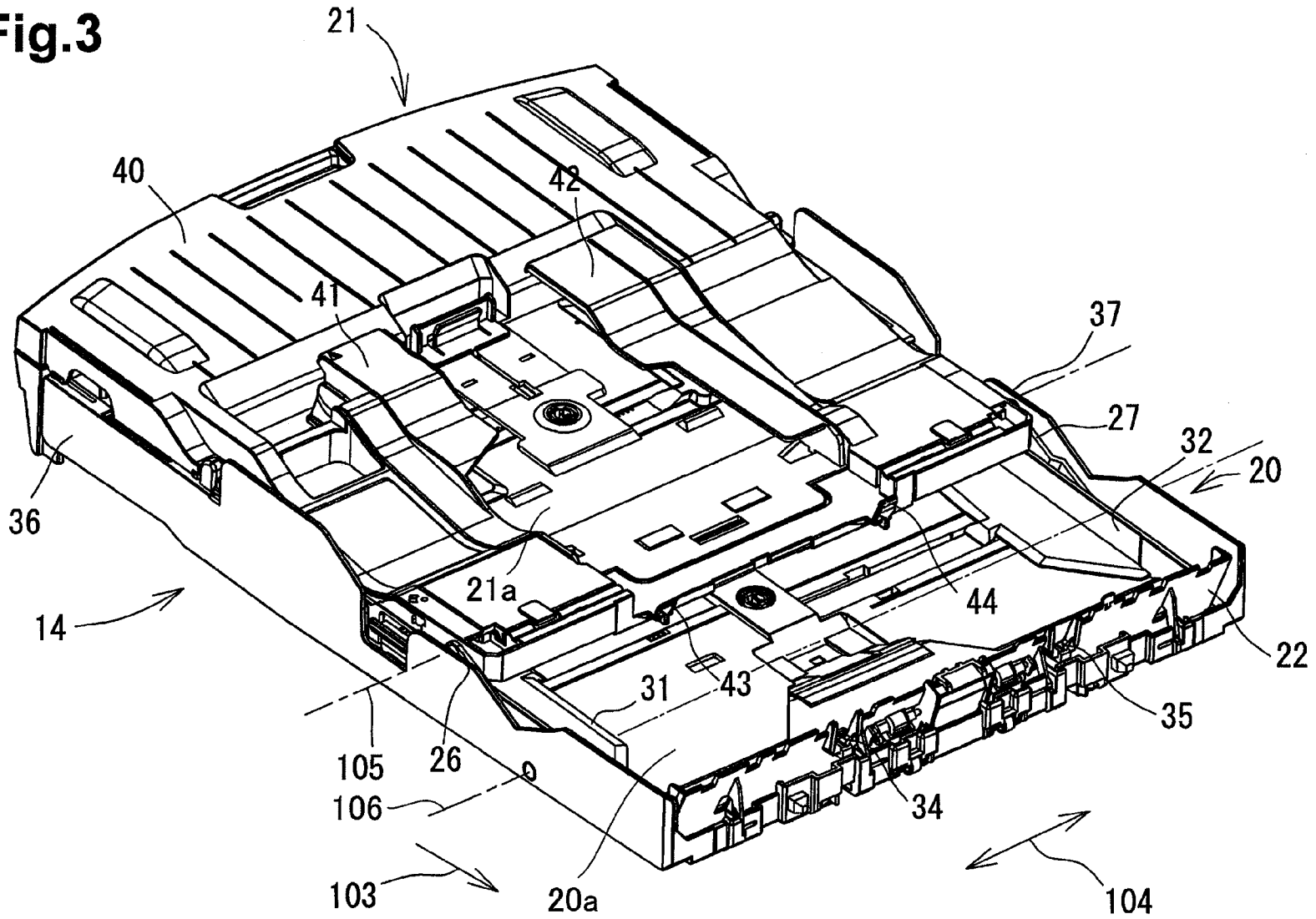
FIG. 3 is a perspective view of a sheet cassette of the printer in which a tray is in a first position.
Figure 4:
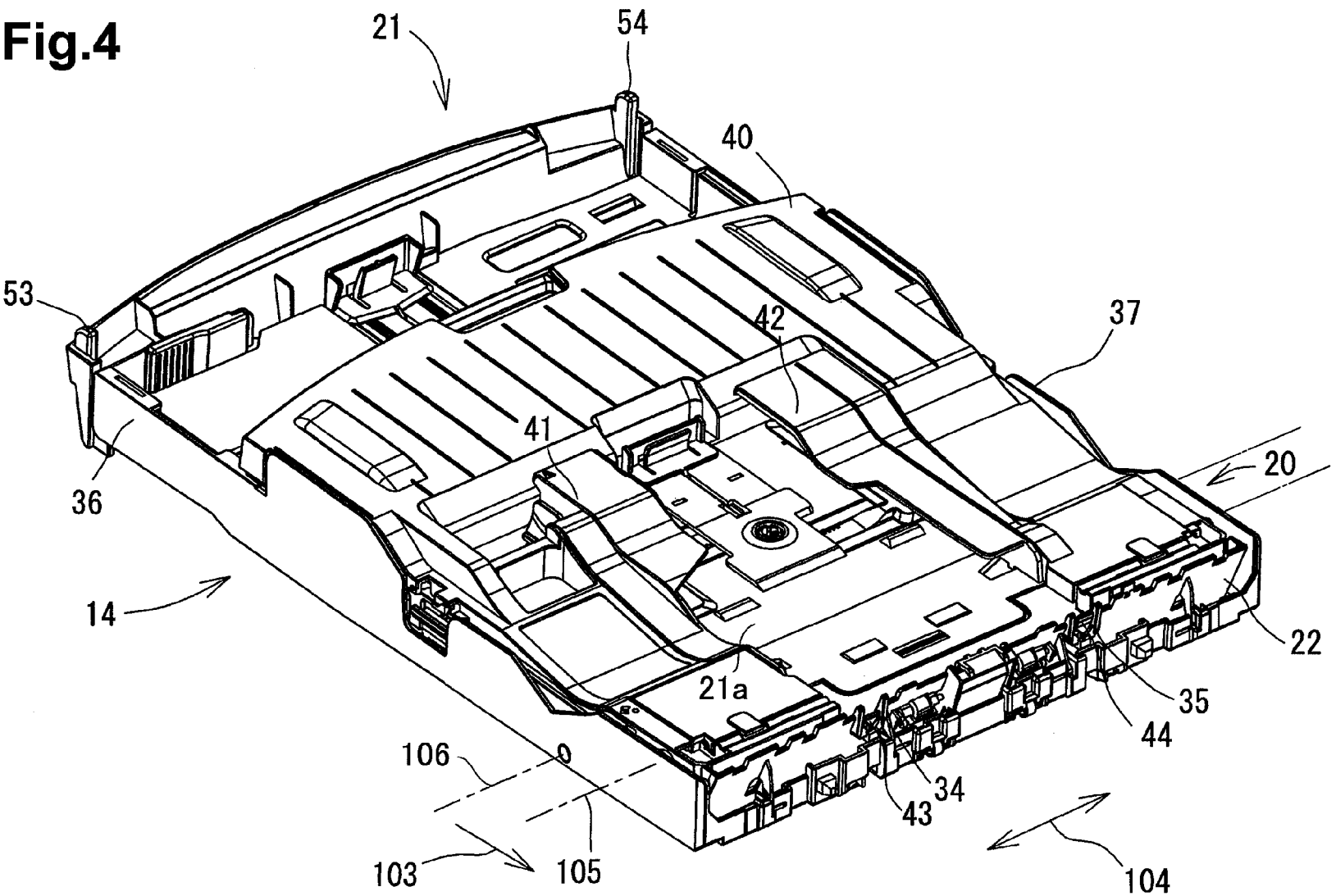
FIG. 4 is a perspective view of the sheet cassette in which the tray is in a second position.
Figure 5:
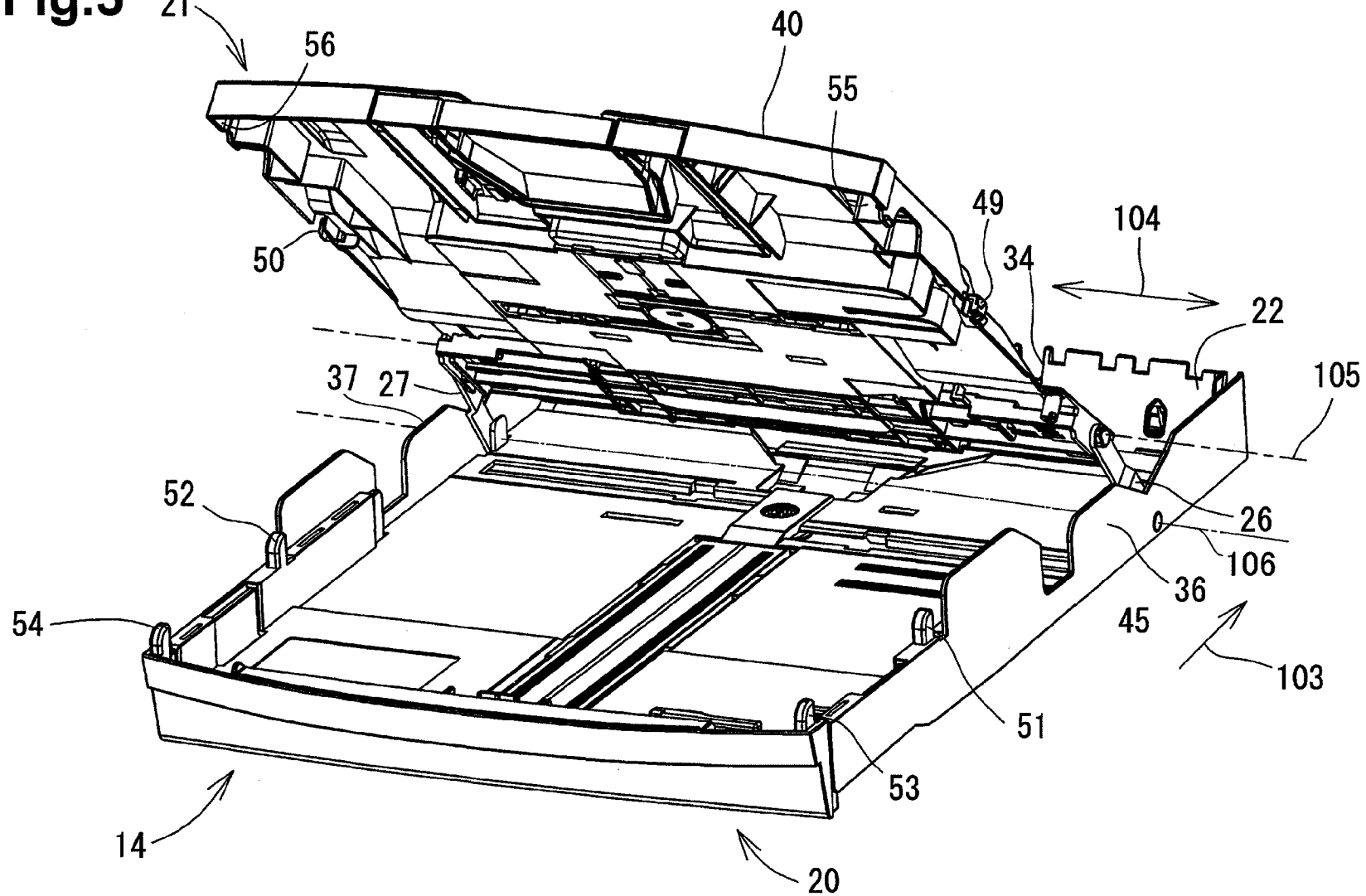
FIG. 5 is a perspective view of the sheet cassette in which the tray in the first position is lifted, as viewed from an upstream end of the sheet cassette in a feeding direction.

As illustrated in FIG. 3 to FIG. 5, the sheet cassette 14 comprises the container 20, the tray 21, and a pair of links 26 and 27. Pivoting of the links 26 and 27 moves the tray 21 between a first position illustrated in FIG. 3 and a second position illustrated in FIG. 4.

The container 20 has a thin, rectangular dish shape. The container 20 is configured to hold, on a holding surface 20*a* thereof, the sheets 17, e.g., A4-size sheets, in a stacked state. The container 20 comprises a pair of side guides 31 and 32. The side guides 31 and 32 come into contact with opposite side edges of the sheets 17, so as to hold the sheets 17 in a stacked state at a predetermined position within the container 20. The side guides 31 and 32 are configured to slide in the width direction 104 of the container 20.

The container 20 has the separation plate 22 on the rear side of the container 20, that is, at the downstream end of the container 20 in the feeding direction 103. The separation plate 22 defines a part of the inner wall surface of the container 20. The separation plate 22 extends across the width of the sheets 17. The separation plate 22 is inclined with respect to the holding surface 20*a* of the container 20. A plurality of claws (not shown) are vertically arranged, at the center of the separation plate 22 in the width direction 104. The claws slightly protrude from the separation plate 22 toward the inside of the container 20, and are arranged vertically in a line at predetermined intervals. When one of the sheets 17 and 18 is fed from the container 20 or the tray 21 in the feeding direction 103, the leading edge of the sheet 17 or 18 comes into contact with the separation plate 22. Even if a plurality of the sheets 17 or 18 are conveyed in an overlapping manner, the leading edges of the sheets 17 or 18 are separated by the claws and only the uppermost sheet 17 or 18 is guided upward along the slope of the separation plate 22.

The separation plate 22 has a pair of notches 34 and 35 extending downward from the upper end thereof and through the thickness thereof (i.e., in the direction substantially along the feeding direction 103). Protruding pieces 43 and 44 of the tray 21 are inserted into the notches 34 and 35, respectively, which are provided on opposite sides of the claws in the width direction 104.

The container 20 is substantially entirely open at the top. The tray 21 is disposed in this opening of the container 20. At the top of the container 20, the tray 21 is configured to move between the first position and the second position along the feeding direction 103. As illustrated in FIG. 3, when the tray 21 is located in the first position, the container 20 is open on the downstream side in the feeding direction 103. In this state, the feed roller 57 enters the container 20 through the opening and comes into contact with the sheets 17 in the container 20. As illustrated in FIG. 4, when the tray 21 is located in the second position, the tray 21 closes the downstream-side opening of the container 20. In this state, the feed roller 57 comes into contact with the sheets 18 stacked on a holding surface 21*a* of the tray 21.

As illustrated in FIG. 3 and FIG. 4, the tray 21 is a thin, rectangular dish-shaped member that is substantially the same as the container 20 in width, and shorter than the container 20 in length in the feeding direction 103. The tray 21 is configured to hold the sheets 18 on the holding surface 21*a* substantially horizontally in a stacked state. The holding surface 21*a* is located on the downstream side of the tray 21 in the feeding direction 103. The tray 21 comprises a pair of side guides 41 and 42 disposed on the downstream side thereof. The side guides 41 and 42 come into contact with opposite side edges of the sheets 18, so as to hold the sheets 18 in a stacked state on the holding surface 21*a*. The side guides 41 and 42 slide in the width direction 104 of the tray 21.

As illustrated in FIG. 3 and FIG. 4, the tray 21 has a flat surface 40 in its downstream-side portion in the feeding direction 103. The flat surface 40 serves as a discharge tray for receiving the sheets 17 and 18 having an image recorded thereon.

As illustrated in FIG. 4 and FIG. 5, side walls 36 and 37 standing on opposite sides of the container 20 in the width direction 104 have bosses 51 to 54 that protrude upward, perpendicularly to the sheet holding surface 20*a*. The bosses 51 to 54 have the same shape and engages in corresponding recesses 55 and 56 of the tray 21.

As illustrated in FIG. 5, the tray 21 has the recesses 55 and 56 at the lower side thereof and at the upstream end in the feeding direction 103. The bosses 51 and 53 are selectively inserted into the recess 55, and the bosses 52 and 54 are selectively inserted into the recess 56. The recesses 55 and 56 are formed at opposite corner portions of the upstream end of the tray 21. The recesses 55 and 56 are formed perpendicularly to the sheet holding surface 21*a*.

When the tray 21 is located in the first position as illustrated in FIG. 3, the bosses 53 and 54 (see FIG. 5) are inserted into the recesses 55 and 56, respectively, and come into contact with the opposite corner portions at the upstream end of the tray 21. Thus, the tray 21 is positioned in a fixed position with respect to the container 20 in the feeding direction 103. When the tray 21 is located in the second position as illustrated in FIG. 4, the bosses 51 and 52 (see FIG. 5) are inserted into the recesses 55 and 56, respectively, and come into contact with the opposite corners of the upstream end of the tray 21. Thus, the tray 21 is positioned in a fixed position with respect to the container 20 in the feeding direction 103. When the tray 21 is located in the first position, the bosses 51 and 52 are inserted into the lower side of the tray 21. However, since the bosses 51 and 52 do not come into contact with anything other than side walls of the tray 21, the bosses 51 and 52 do not position the tray 21 in a fixed position with respect to the container 20 in the feeding direction 103.

As described above, the tray 21 has the protruding pieces 43 and 44 protruding in the feeding direction 103. As illustrated in FIG. 4, when the tray 21 is moved to the second position, the protruding pieces 43 and 44 are inserted into the notches 34 and 35 of the separation plate 22, respectively. The notches 34 and 35 support the protruding pieces 43 and 44 from below.

As illustrated in FIG. 3 and FIG. 5, the links 26 and 27 are disposed on the downstream side of the tray 21 in the feeding direction 103 and at opposite ends of the tray 21 in the width direction 104. The links 26 and 27 connect the tray 21 to the container 20 such that the links 26 and 27 pivot with respect to the container 20. Pivoting of the links 26 and 27 moves the tray 21 between the first position and the second position.

Each of the links 26 and 27 is a long, flat plate-like member. One end of each of the links 26 and 27 is rotatably connected to a downstream portion of the tray 21 in the feeding direction 103, at a corresponding one of opposite ends of the tray 21 in the width direction 104. The tray 21 is pivotable about the one end of each of the links 26 and 27. Specifically, the tray 21 is pivotable about a pivot axis 105 that passes through the one ends of the links 26 and 27. The pivot axis 105 is perpendicular to the feeding direction 103 and parallel to the holding surface of the container 20. The pivot axis 105 is parallel to the width direction 104. The other end of each of the links 26 and 27 is rotatably connected to a corresponding one of the opposite side walls 36 and 37 of the container 20. The links 26 and 27 are pivotable about the other ends thereof connected to the container 20. Specifically, the links 26 and 27 are 27 are pivotable about a pivot axis 106 that passes through the other ends of the links 26 and 27. The pivot axis 106 is parallel to the pivot axis 105.

When the links 26 and 27 pivot about the pivot axis 106 while lying and standing with respect to the container 20, the tray 21 moves between the first position and the second position. In other words, when the tray moves between the first position and the second position, the links 26 and 28 pivot between a first pivot position and a second pivot position, via a third pivot position. A distance between the other ends of the links 26 and 27 connected to the tray 21 and the first holding surface 20*a* is maximized when the links 26 and 28 are in the third pivot position.

As illustrated in FIG. 5, the tray 21, when located in the first position, is pivotable about the pivot axis 105, such that the upstream end of the tray 21 in the feeding direction 103 is lifted away from the container 20. This allows the upstream side of the container 20 to be widely opened and facilitates loading of sheets 17 into the container 20. Although not shown in the drawings, the tray 21, when located in the second position, is also pivotable upward away from the container 20.

How to use the sheet cassette 14 will now be described. As illustrated in FIG. 5, when the upstream end of the tray 21 in the feeding direction 103 is lifted from the container 20, sheets 17 of a desired size can be loaded in the container 20. When the tray 21 is brought back onto the container 20, the bosses 53 and 54 of the container 20 are inserted into the recesses 55 and 56 of the tray 21, respectively. Thus, the tray 21 is positioned in a fixed position with respect to the container 20 in the feeding direction 103.

When the tray 21 is located in either of the first position (see FIG. 3) and the second position (see FIG. 4), sheets 18 can be loaded between the side guides 41 and 42 of the tray 21 by inserting the sheets 18 in a direction opposite the feeding direction 103, from the downstream side in the feeding direction 103.

The sheet cassette 14 loaded with sheets 17 and 18 respectively in the container 20 and the tray 21 is inserted into and removed from the multi-function device 10 through the opening 13. When the tray 21 is located in the first position, the container 20 is open at the top, on the downstream side in the feeding direction 103, that is, on the side adjacent to the separation plate 22. The feed roller 57 enters the container 20 through the opening comes into contact with the sheets 17 in the container 20. If a plurality of the sheets 17 are fed by the feed roller 57 in the feeding direction 103, the leading edges of the sheets 17 come into contact with the separation plate 22. Then, the sheets 17 are separated by the claws, guided upward one by one along the slope of the separation plate 22, and fed to the sheet conveying path 23.

The sheet 17 having an image recorded thereon by the recording unit 24 is discharged from the sheet conveying path 23 and is supported on the flat surface 40 of the tray 21. That is, the tray 21 serves as a discharge tray. The tray 21 located in the first position closes the upstream side of the container 20 in the feeding direction 103. This prevents dust having entered through the opening 13 from further entering the container 20 and adhering to the sheets 17.

In order to perform image recording on sheets 18 loaded on the tray 21, the sheet cassette 14 is removed from the multi-function device 10, and the tray 21 is moved from the first position to the second position. As described above, the tray 21 is connected to the container 20 by the links 26 and 27 that are pivotable with respect to the container 20. The tray 21 is moved between the first position and the second position by being guided by pivoting of the links 26 and 27. When the tray 21 is located in the second position, the bosses 51 and 52 of the container 20 are inserted into the recesses 55 and 56 of the tray 21, respectively, and the tray 21 is positioned in a fixed position with respect to the container 20 in the feeding direction 103. At the same time, the protruding pieces 43 and 44 of the tray 21 are inserted into the notches 34 and 35 of the separation plate 22, respectively, and the tray 21 is supported by the separation plate 22 from below.

After the tray 21 is moved to the second position, the sheet cassette 14 is inserted into the multi-function device 10 again. When the tray 21 is located in the second position, the container 20 is closed on the downstream side in the feeding direction 103, that is, on the side adjacent to the separation plate 22. The sheets 18 loaded on the tray 21 are placed on the closed front side of the container 20, and the feed roller 57 comes into contact with the sheets 18. If a plurality of the sheets 18 on the tray 21 are fed by the feed roller 57 in the feeding direction 103, the leading edges of the sheets 18 come into contact with the separation plate 22. Then, the sheets 18 are separated by the claws, guided upward one by one along the slope of the separation plate 22, and fed to the sheet conveying path 23. The sheet 18 having an image recorded thereon by the recording unit 24 is discharged from the sheet conveying path 23 and is supported on the flat surface 40 of the tray 21.

As described above, in the multi-function device 10 according to the first embodiment of the invention, the tray 21 is disposed on and above the container 20 and is brought into engagement, through the bosses 51 to 54, with the container 20 from above, in the first position and the second position. By such engagement, the tray 21 is positioned and retained in fixed positions with respect to the container 20 in the feeding direction 103. By lifting the tray 21 from the container 20, the tray 21 is released from the bosses 51 to 54. The tray 21 released from the container 21 is readily guided, by the vertical pivoting of the links 26 and 27, into the first position and the second position.

Figure 6A:
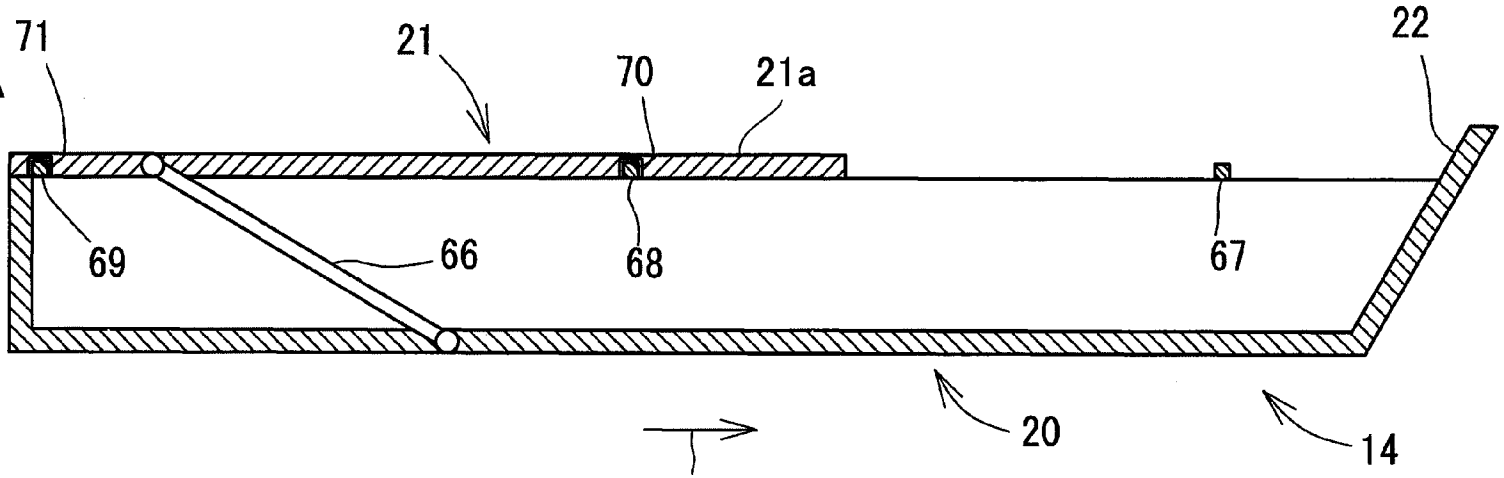
FIG. 6A and FIG. 6B are schematic cross-sectional views of a sheet cassette according to a second embodiment of the invention.
Figure 6B:
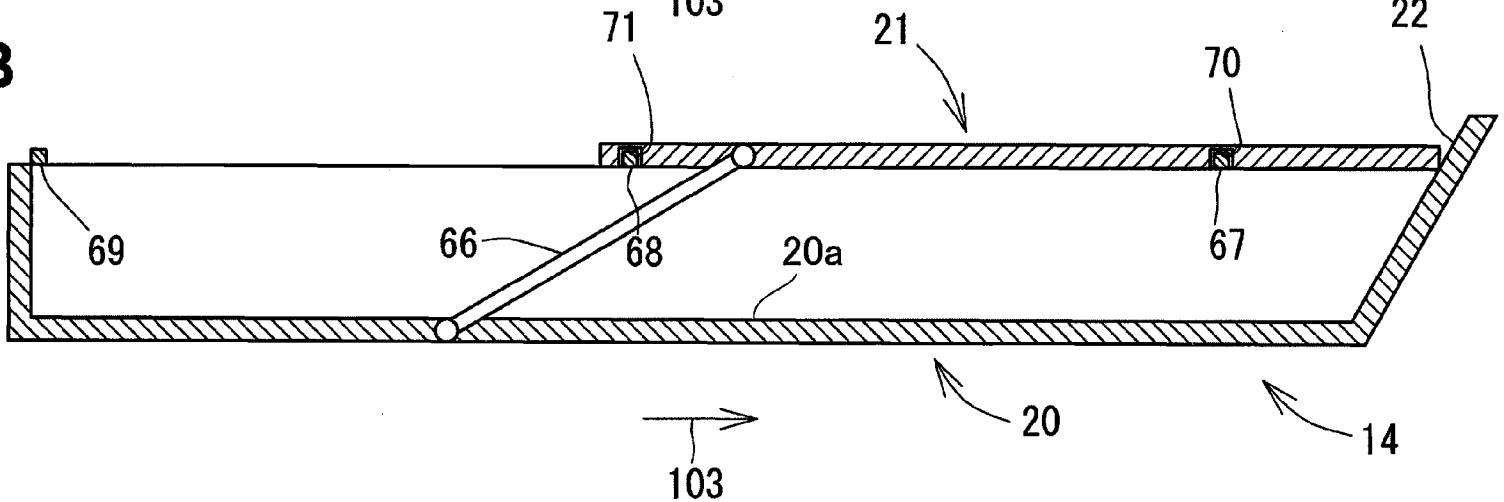

Referring now to FIGS. 6A and 6B, a second embodiment of the invention will be described. A multi-function device 10 of the second embodiment differs from that of the first embodiment in terms of the arrangement of links. Therefore, although a link 66 that differs from the links 26 and 27 of the first embodiment will be described in detail, a detailed description of the other configurations will be omitted here. In the second embodiment, components indicated by the same reference numerals as those used in the first embodiment are identical to the corresponding components of the first embodiment.

The link 66 and another link (not shown) are disposed in a pair on the upstream side of the tray 21 in the feeding direction 103, at opposite ends of the tray 21 in the width direction 104. Only the link 66 is shown in FIG. 6A and FIG. 6B but, as in the case of the links 26 and 27 described above, another link is provided so as to oppose the link 66 in a direction perpendicular to the sheet plane of FIGS. 6A and 6B, i.e., in the width direction 104 of the sheet cassette 14. The link 66 connects the tray 21 to the container 20 such that the tray 21 is pivotable with respect to the container 20. Pivoting of the link 66 moves the tray 21 between the first position and the second position.

The link 66 is a long, flat plate-like member. One end of the link 66 is rotatably connected to an upstream portion of the tray 21 in the feeding direction 103, at a corresponding one of opposite ends of the tray 21 in the width direction 104. The tray 21 is pivotable about the one end of the link 66 connected to the tray 21. The other end of the link 66 is rotatably connected to a corresponding one of the opposite side walls 36 and 37 of the container 20. The link 66 is pivotable about the other end thereof connected to the container 20. When the link 66 pivots about the other end thereof connected to the container 20, while lying and standing with respect to the container 20, the tray 21 moves between the first position and the second position. The tray 21, when located in the first position or in the second position, is pivotable about the one end of the link 66 connected to the tray 21 such that the downstream end of the tray 21 in the feeding direction 103 is lifted away from the container 20. This allows the downstream side of the container 20 to be widely opened and facilitates loading of sheets 17 into the container 20.

As illustrated in FIG. 6A and FIG. 6B, the side wall 36 (see FIG. 3 etc.) standing on one of the opposite sides of the container 20 in the width direction 104 has three bosses 67 to 69 protruding upward from the upper end of the side wall 36. The tray 21 has a recess 70 at a position slightly closer to the downstream end than to the center, and a recess 71 at a position adjacent to the upstream end. The bosses 67 to 69 can be inserted into corresponding recesses 70 and 71. Although FIG. 6A and FIG. 6B illustrate only the bosses 67 to 69 and the recesses 70 and 71 provided on one of the opposite sides of the container 20 and tray 21 in the width direction 104, bosses and recesses identical to the bosses 67 to 69 and the recesses 70 and 71 are provided on the other side of the container 20 and tray 21 in the width direction 104.

As illustrated in FIG. 6A, when the tray 21 is located in the first position, the bosses 68 and 69 engage in the recesses 70 and 71, respectively, to restrict movement of the tray 21 in the feeding direction 103. As illustrated in FIG. 6B, when the tray 21 is located in the second position, the bosses 67 and 68 engage in the recesses 70 and 71, respectively, to restrict movement of the tray 21 in the feeding direction 103.

As described above, the link 66 is disposed on the upstream side of the tray 21 in the feeding direction 103. This allows the user to move the tray 21 between the first position and the second position stably by holding the downstream end of the tray 21 in the feeding direction 103.

Figure 7A:
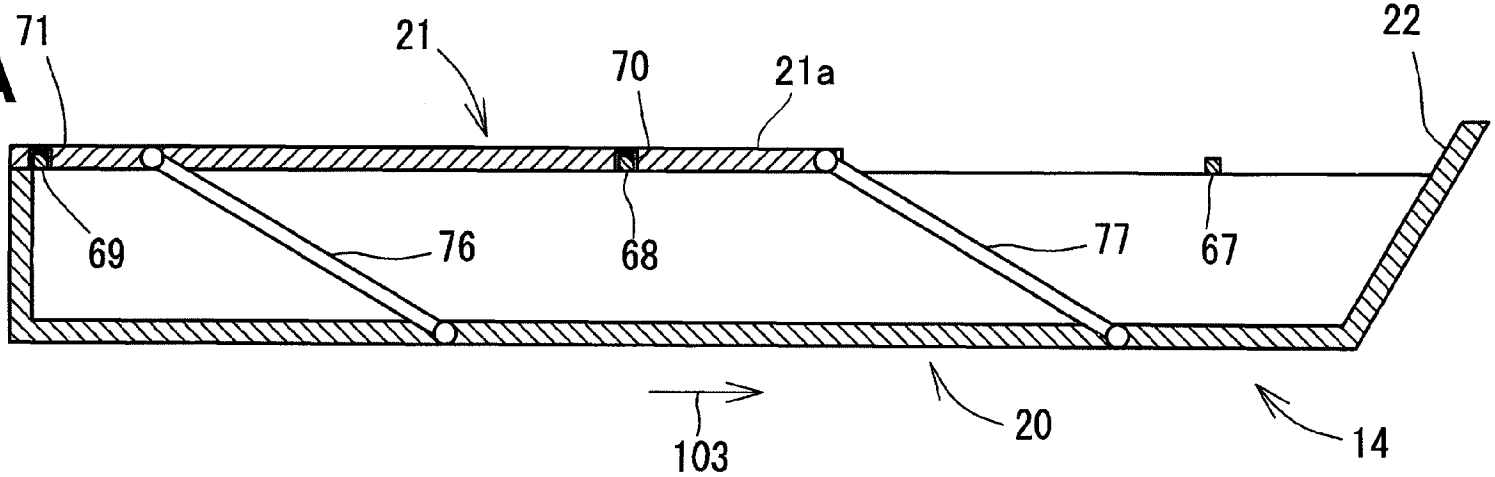
FIG. 7A and FIG. 7B are schematic cross-sectional views of a sheet cassette according to a third embodiment of the invention.
Figure 7B:
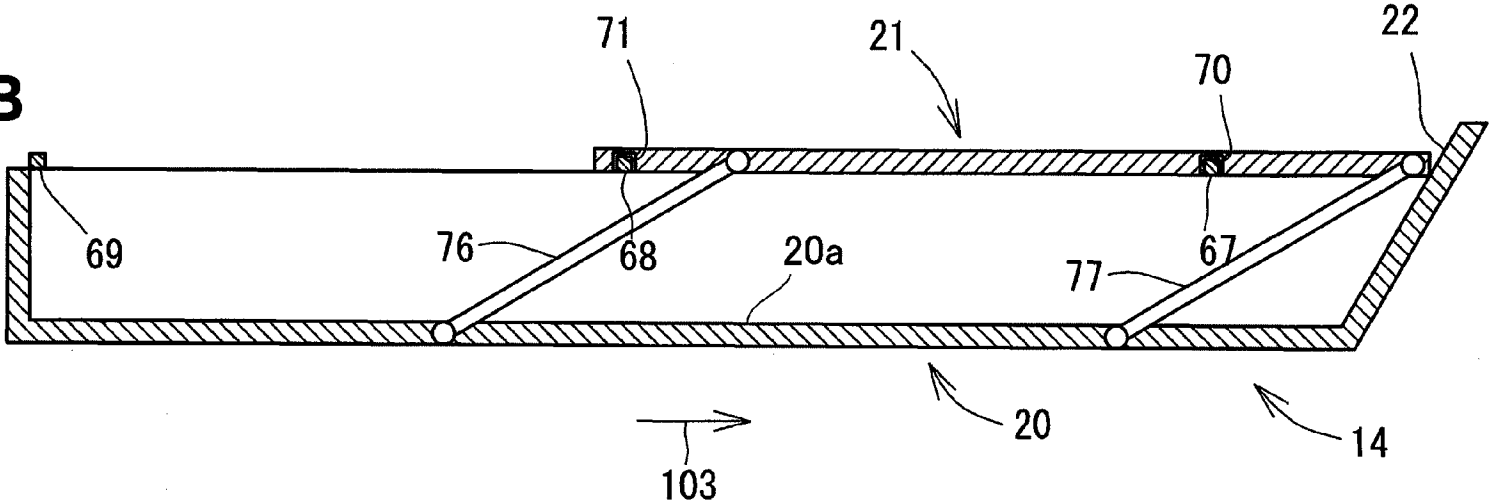
Figure 8:
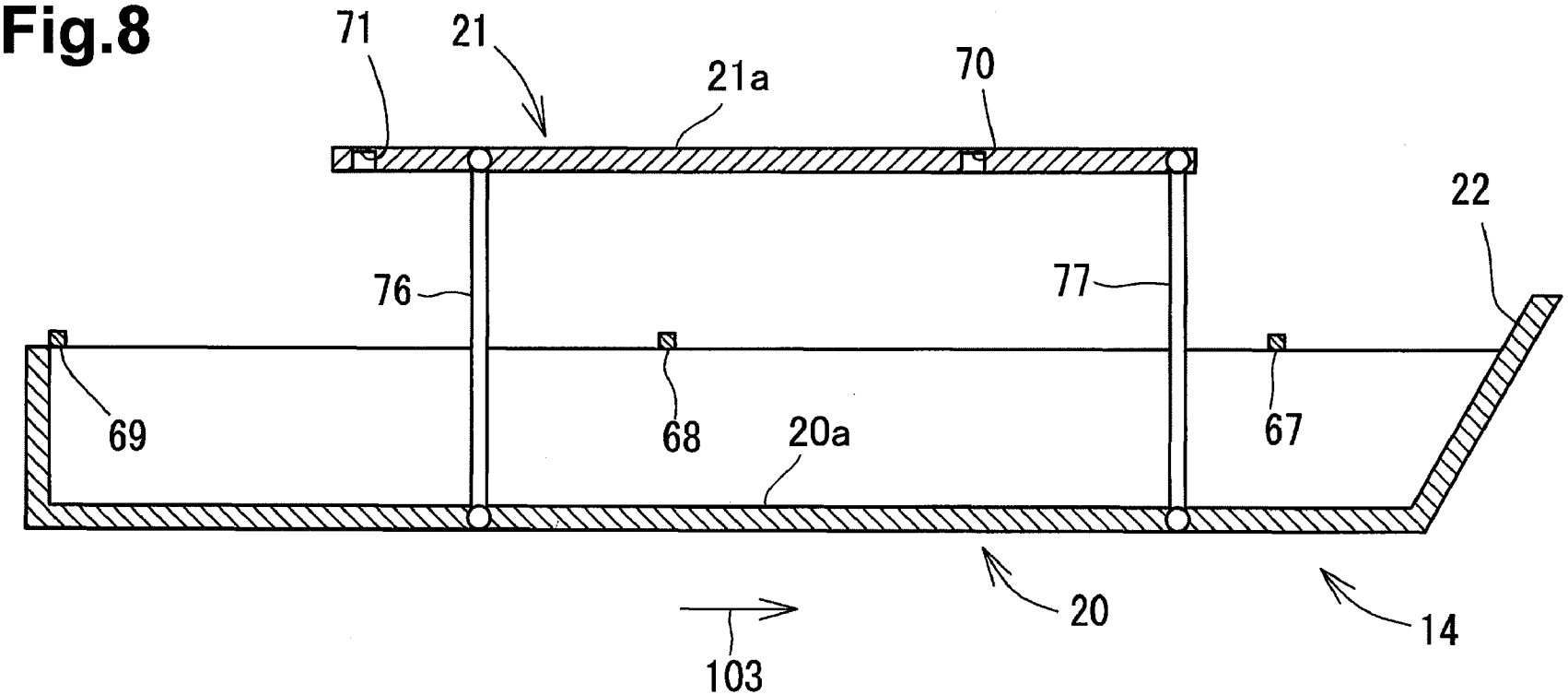
FIG. 8 is a schematic cross-sectional view of the sheet cassette in which a tray is in a third pivoting position, according to the third embodiment of the invention.

Referring now to FIGS. 7A, 7B, and 8, a third embodiment of the invention will be described. A multi-function device 10 of the third embodiment differs from that of the first embodiment in terms of the arrangement and number of links. Therefore, although links 76 and 77 that differ from the links 26 and 27 of the first embodiment will be described in detail, a detailed description of the other configurations will be omitted here. In the third embodiment, components indicated by the same reference numerals as those used in the first embodiment are identical to the corresponding components of the first embodiment.

As illustrated in FIG. 7A and FIG. 7B, the link 76 and another link (not shown) are provided in a pair on the upstream side of the tray 21 in the feeding direction 103, at opposite ends in the width direction 104 of the tray 21. As also illustrated in FIG. 7A and FIG. 7B, the link 77 and another link (not shown) are provided in a pair on the downstream side of the tray 21 in the feeding direction 103, at opposite ends in the width direction 104 of the tray 21. The links 76 and 77 connect the tray 21 to the container 20 such that the tray 21 is movable with respect to the container 20. While only the links 76 and 77 at one end in the width direction 104 of the tray 21 are shown in FIG. 7A, FIG. 7B, and FIG. 8, the other links are provided so as to oppose the links 76 and 77, respectively, in a direction perpendicular to the sheet plane of FIGS. 7A, 7B, and 8, i.e., in the width direction 104. In other words, the sheet cassette 14 comprises a four-link mechanism including a pair of links 76 and a pair of links 77. Pivoting of the two pairs of links 76 and 77 moves the tray 21 between the first position and the second position.

The links 76 and 77 are long, flat plate-like members. One end of the link 76 is rotatably connected to an upstream portion of the tray 21 in the feeding direction 103, at a corresponding one of opposite ends of the tray 21 in the width direction 104. The other end of link 76 is rotatably connected to a corresponding one of the side walls 36 or 37. One end of the link 77 is rotatably connected to a downstream portion of the tray 21 in the feeding direction 103, at a corresponding one of opposite ends of the tray 21 in the width direction 104. The other end of link 77 is rotatably connected to a corresponding one of the side walls 36 or 37 of the container 20. When the links 76 and 77 pivot about the other ends thereof connected to the container 20 while lying and standing with respect to the container 20, the tray 21 moves between the first position and the second position.

In the third embodiment, the container 20 has, on each side wall 36 and 37 thereof, the three bosses 67 to 69, while the tray 21 has, on each side thereof, the recesses 70 and 71 into which the bosses 67 to 69 can be inserted. The bosses 67 to 69 and the recesses 70 and 71 are similar to those in the second embodiment, and thus will not be described in detail here.

As illustrated in FIG. 8, when the tray 21 is located in a third position which is intermediate between the first position (see FIG. 7A) and the second position (see FIG. 7B), the links 76 and 77 are perpendicular to the sheet holding surface of the tray 21 and the sheet holding surface of the container 20, and a distance between the sheet holding surface 21*a* of the tray 21 and the sheet holding surface 20*a* of the container 20 is maximized. In this state, the links 76 and 77 may be locked, for example, by providing dome-shaped protrusions thereon and forming, in the side wall 36, recessed portions in which the corresponding protrusions engage. This facilitates loading of the sheets 17 into the container 20 from the space between the tray 21 and the container 20.

The four-link mechanism including the links 76 and 77 allows the tray 21 move with respect to the container 20 while maintaining a parallel relationship therebetween. Specifically, when the links 76 and 77 pivot vertically about the other ends thereof connected to the container 20, the tray moves stably between the first position and the second position while the holing surface 21*a* of the tray 21 is maintained parallel to the holding surface 20*a* of the container 20.

The positions of the links 76 and 77 of the four-link mechanism are not limited to the upstream side and downstream side of the tray 21, respectively, in the feeding direction 103, and may be changed as long as the operation and effect described above can be achieved.

In the above-described embodiments, the tray moves between the first position and the second position when at least a pair of links pivot vertically about a pivot axis that extend in a direction perpendicular to the feeding direction 103 and parallel to the first holding surface 20*a*. The tray 21 is positioned and retained in the first position or in the second position by vertical engagement of at least one recess of the tray 21 with one of at least two bosses of the container 20. Such engagement prevents the tray from moving substantially horizontally in the feeding direction 103. In addition, a restricting member may be disposed at the opening 13 of the multi-function device 10 such that the restricting member prevents vertical pivoting of the links when the sheet cassette 14 is in the opening 13.

While the invention has been described in connection with preferred embodiments, it will be understood by those of ordinary skill in the art that other variations and modifications of the preferred embodiments described above may be made without departing from the scope of the invention. Other embodiments will be apparent to those skilled in the art from a consideration of the specification or practice of the invention disclosed herein. It is intended that the specification and the described examples only are considered as exemplary of the invention, with the true scope of the invention being defined by the following claims.

What is claimed is:

1. A sheet storing device comprising:

a container comprising a first holding surface configured to hold a first sheet thereon;

a tray positioned at an upper side of the container, the tray comprising a second holding surface configured to hold a second sheet thereon, wherein the tray is configured to selectively move between a first position and a second position downstream from the first position in a first direction;

a positioning unit configured to selectively position the tray in one of the first position and the second position; and a linking unit configured to link the tray to the container and to pivot about a particular pivot axis which extends in a second direction perpendicular to the first direction and parallel to the first holding surface of the container, wherein the linking unit pivots to selectively move the tray between the first position and the second position, wherein the linking unit comprises a plurality of particular links opposing each other in the second direction, and each particular link comprises a first connection portion rotatably coupled to the container and a second connection portion rotatably coupled to the tray, wherein the particular pivot axis passes through the first connection portion of each particular link and when each particular link pivots about the particular pivot axis, the tray selectively moves between the first position and the second position; and wherein the second holding surface faces away from the first holding surface in the first and second positions.

2. The sheet storing device according to claim 1, wherein the positioning unit comprises an engaging member formed in the tray, and a first positioning member and a second positioning member formed in the container, wherein the first positioning member is located upstream of the second positioning member in the first direction, and the engaging member is configured to engage the first positioning member when the tray is in the first position, and to engage the second positioning member when the tray is in the second position.

3. The sheet storing device according to claim 2, wherein the engaging member comprises one of a projection and a recess which extends in a direction perpendicular to the second holding surface of the tray, and each of the first positioning member and the second positioning member comprises the other of the projection and the recess which extends in a direction perpendicular to the first holding surface of the container.

4. The sheet storing device according to claim 1, wherein the tray is configured to pivot about a further pivot axis which passes through the second connection portion of each particular link, and the further pivot axis is parallel to the particular pivot axis.

5. The sheet storing device according to claim 1, wherein the second connection portion of each particular link is connected to a corresponding one of opposite ends of the tray in the second direction at a downstream side of the tray in the first direction.

6. The sheet storing device according to claim 1, wherein the second connection portion of each particular link is connected to a corresponding one of opposite ends of the tray in the second direction at an upstream side of the tray in the first direction.

7. The sheet storing device according to claim 1, wherein the first connection portion of each particular link is connected to a corresponding one of opposite ends of the container in the second direction.

8. The sheet storing device according to claim 1, wherein the first connection portion of each particular link comprises a corresponding end of each particular link, and the second connection portion of each particular link comprises another corresponding end of each particular link.

9. The sheet storing device according to claim 1, wherein the linking unit further comprises a plurality of further links, and each further link comprises a first connection portion rotatably coupled to the container and a second connection portion rotatably coupled to the tray, and is configured to pivot about a third pivot axis that passes through the first connection portion of each further link, and the third pivot axis is parallel to the particular pivot axis.

10. The sheet storing device according to claim 9, wherein the first connection portion of each further link is connected to a corresponding one of opposite ends of the container in the second direction, and the second connection portion of each further link is connected to a corresponding one of opposite ends of the tray in the second direction.

11. The sheet storing device according to claim 9, wherein the first connection portion of each further link comprises a corresponding end of each further link, and the second connection portion of each further link comprises another corresponding end of each further link.

12. The sheet storing device according to claim 9, wherein when the plurality of particular links and the plurality of further links pivot about the particular pivot axis and the third pivot axis, respectively, the tray is configured to move between the first position and the second position while the second holding surface of the tray is maintained parallel to the first holding surface of the container.

13. The sheet storing device according to claim 12, wherein when the tray is in a third position which is between the first position and the second position in the first direction, a distance between the first holding surface of the container and the second holding surface of the tray is maximized.

14. The sheet storing device according to claim 1, wherein when the tray moves between the first position and the second position, each particular link pivots between a first pivot position and a second pivot position via a third pivot position, and a distance between the second connection portion of each particular link and the first holding surface is maximized when each particular link is in the third pivot position.

* * * * *